US009278427B2

(12) United States Patent
Numata

(10) Patent No.: US 9,278,427 B2
(45) Date of Patent: Mar. 8, 2016

(54) DUST COLLECTION COVER OF DISK GRINDER

(75) Inventor: Fumitoshi Numata, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 550 days.

(21) Appl. No.: 13/496,097

(22) PCT Filed: Sep. 1, 2010

(86) PCT No.: PCT/JP2010/064902

§ 371 (c)(1),
(2), (4) Date: Mar. 28, 2012

(87) PCT Pub. No.: WO2011/030702

PCT Pub. Date: Mar. 17, 2011

(65) Prior Publication Data

US 2012/0184193 A1 Jul. 19, 2012

(30) Foreign Application Priority Data

Sep. 14, 2009 (JP) ..... 2009-211524

(51) Int. Cl.
*B24B 55/05* (2006.01)
*B24B 23/02* (2006.01)

(52) U.S. Cl.
CPC ..... *B24B 55/05* (2013.01); *B24B 23/02* (2013.01)

(58) Field of Classification Search
CPC ..... B24B 55/05; B24B 23/02
USPC ..... 451/456, 451, 359, 453
IPC ..... B24B 55/10,55/00, 55/04, 55/05, 23/00, B24B 23/02, 55/06
See application file for complete search history.

(56) References Cited

U.S. PATENT DOCUMENTS

| | | | | |
|---|---|---|---|---|
| 3,673,744 | A * | 7/1972 | Oimoen | 451/353 |
| 3,882,644 | A * | 5/1975 | Cusumano | 451/359 |
| 5,411,433 | A * | 5/1995 | Keller | 451/451 |
| 5,713,785 | A * | 2/1998 | Nishio | 451/451 |
| 5,791,979 | A * | 8/1998 | Duncan et al. | 451/456 |
| 6,027,399 | A * | 2/2000 | Stewart | 451/353 |
| 6,471,574 | B1 | 10/2002 | Rupprecht et al. | |
| 7,223,161 | B2 * | 5/2007 | Kodani et al. | 451/354 |
| 7,625,265 | B2 * | 12/2009 | Woods et al. | 451/451 |

(Continued)

FOREIGN PATENT DOCUMENTS

| | | | |
|---|---|---|---|
| CN | 101422878 | A | 5/2009 |
| EP | 1074341 | A2 | 2/2001 |

(Continued)

OTHER PUBLICATIONS

Datasheet for commercial product in Patent 8137165, Apr. 2014.*

(Continued)

*Primary Examiner* — Joseph J Hail
*Assistant Examiner* — Marc Carlson
(74) *Attorney, Agent, or Firm* — Oliff PLC

(57) ABSTRACT

A dust collection cover may be made from resin for achieving a reduction in its typical weight. In such a configuration, a disk-shaped grinding stone for grinding a steel material is preferably not attachable due to interference of an attachment-restricting portion. It is preferred that only a cup-shaped diamond wheel for work that generally does not produce heated iron powder or the like is attachable.

10 Claims, 8 Drawing Sheets

(56) References Cited

U.S. PATENT DOCUMENTS

| | | | | |
|---|---|---|---|---|
| 8,137,165 | B2 * | 3/2012 | Loveless et al. | 451/456 |
| 8,282,447 | B1 * | 10/2012 | Buser | 451/451 |
| 8,622,788 | B2 * | 1/2014 | Eto et al. | 451/451 |
| 8,702,478 | B2 * | 4/2014 | Loveless et al. | 451/453 |
| 2007/0178815 | A1 * | 8/2007 | Buser | 451/451 |
| 2008/0171501 | A1 * | 7/2008 | Woods et al. | 451/451 |
| 2009/0181604 | A1 * | 7/2009 | Loveless et al. | 451/451 |
| 2009/0181605 | A1 * | 7/2009 | Loveless et al. | 451/456 |
| 2009/0186559 | A1 * | 7/2009 | Loveless et al. | 451/28 |
| 2011/0275293 | A1 * | 11/2011 | Eto et al. | 451/453 |

FOREIGN PATENT DOCUMENTS

| | | | |
|---|---|---|---|
| EP | 1 321 228 | A1 | 6/2003 |
| JP | A-51-142796 | | 12/1976 |
| JP | 52-109290 | | 8/1977 |
| JP | S 52-109290 | U * | 8/1977 |
| JP | A-2005-144599 | | 6/2005 |
| JP | A-2005-238417 | | 9/2005 |
| JP | 2005-288566 | A * | 10/2005 |
| JP | A-2005-288566 | | 10/2005 |
| JP | U-3132778 | | 6/2007 |
| JP | A-2009-172696 | | 8/2009 |
| WO | WO 2010/087072 | A1 | 8/2010 |

OTHER PUBLICATIONS

Flyer for commercial product in Patent 8137165, May 2012.*
International Search Report dated Oct. 5, 2010 issued in International Patent Application No. PCT/JP2010/064902 (with translation).
Chinese Office Action issued in Application No. 2010800480530 issued on May 6, 2014 (with translation).
Aug. 10, 2015 Search Report issued in European Application No. 10815299.2.

* cited by examiner

DUST COLLECTION COVER OF DISK GRINDER

TECHNICAL FIELD

Embodiments of the present invention relate to a dust collection cover of a disk grinder.

BACKGROUND OF THE INVENTION

A hand-held type disk grinder includes a configuration in which a spindle with a grinding tool attached thereto is rotated at a high speed by an electric motor disposed within a tool main body. Different types of grinding tools may be attached to the spindle depending on the substance of the work. For example, when debarring work for a steel material or a bead cutting work for a welded surface is performed, a disk-shaped grinding stone may be attached. When work for grinding concrete mating surfaces or chamfering a stone material is performed, a cup-shaped diamond wheel may be attached.

When a disk-shaped grinding tool is attached to perform grinding work on a steel plate or the like, only the front tip is pressed in a circumferential direction against the subject being worked on. A dust collection cover substantially covering about half the circumference on the rear side of the grinding tool may be attached. Meanwhile, when grinding work is performed using a cup-shaped diamond wheel, generally the entire circumference may be pressed against a surface to be ground. In such a situation, it is preferable that a dust collection cover having a shape substantially covering the entire circumference of the diamond wheel is preferably attached. In addition, a dust collection bag may be attached to the dust collection cover. In other embodiments, a dust collector may be connected to the dust collection cover via a hose in order to collect dust more completely.

SUMMARY OF THE INVENTION

When the front section of the dust collection cover is separable from the cover main body in order to enable an edge cut, a disk-shaped (a flat plate shaped) grinding stone is typically attached instead of the cup-shaped grinding stone. In this way, when the auxiliary cover is removed, the front section of the grinding stone protrudes from the cover main body enabling grinding of steel material or the like.

When using a disk-shaped grinding stone to grind steel material or the like, sparks or heated iron powder may be produced and scattered. In addition, a portion of the grinding stone may be broken off and cause damage to the cover main body. For this reason, the conventional dust collection cover is made of a heavy material such as steel plate. Such steel dust collection covers are used for heat (fire) and shock resistance. Due to their heavy weight, however, their ease of the portability is lowered and their usability is impaired.

It is an object of certain embodiments of the present invention to enable a so-called edge cut by removing an auxiliary cover at a front section of a dust collection cover from a cover main body. The dust collection cover typically covers an entire cup-shaped grinding stone. Increased portability and usability of a disk grinder or other power tool may be increased by reducing the weight of the dust collection cover.

According to the dust collection cover defined in claim 1, a cover main body and an auxiliary cover are made from synthetic resin, and therefore, it is possible to create a lightweight dust collection cover.

In addition, the auxiliary cover can be separated from the cover main body such that a portion of the grinding tool protrudes from the cover main body, so that a so-called edge cut can be performed.

Furthermore, in embodiments of this dust collection cover, the disk-shaped grinding tool is preferably not attachable to a spindle, due to interference caused by an attachment-restricting portion. A disk-shaped grinding tool typically has a flat and round-disk shape, and therefore, the height difference between (1) a spindle attachment portion to a spindle and (2) a grinding portion contacting a material to be ground, such as a steel material, is small. When an attempt is made to attach the disk-shaped grinding tool to the spindle, attachment is preferably not possible due to interference with the attachment-restricting portion arranged near the cover main body. In contrast, a cup-shaped grinding tool has a large height dimension between a spindle attachment and a grinding portion and therefore, can be attached to the spindle without being interfered with by the attachment-restricting portion.

In this way, preferably only the cup-shaped grinding tool such as a cup-shaped diamond wheel can be attached, and the disk-shaped grinding tool cannot be attached. In this way work that may generate sparks or heated iron powder can be prevented. Similarly, work resulting in broken portions of the grinding stone can be reduced. A lightweight resin dust collection cover can be used while still protecting the cover main body and the auxiliary cover from damage.

In the dust collection cover defined in claim 2, the cover main body may be made from a synthetic resin is supported in a floating manner, so that impacts on the cover main do not interfere with the intended operations of the tool.

According to the dust collection cover defined in claim 3, the cover main body and the auxiliary cover are attached in a floating manner by a leaf spring (the resin spring) integrally molded with the cover main body. Since the resilient member is integrally attached to the cover main body, the number of parts during assembly of the dust collecting cover can be reduced. This may result in improved ease of assembly.

According to the dust collection cover defined in claim 4, the resin spring may be formed to have a tapered shape with respect to the width dimension and the plate thickness dimension toward the tip end. Therefore, when an external bending force is applied to the resin spring a bending deformation occurs starting from the tip end. Hence, it is possible to reduce or avoid stress concentration on a base end of the resin spring. This thereby increases the durability of the resin spring.

According to the dust collection cover defined in claim 5, a gap preferably does not exist where the auxiliary cover is coupled to the cover main body. It is preferably possible to completely cover the entire circumference of the grinding tool and thereby maintain dust collection efficiency which could be reduced when there is allowed separation of the auxiliary cover and the cover main body.

DETAILED DESCRIPTION OF THE INVENTION

Figure 1:
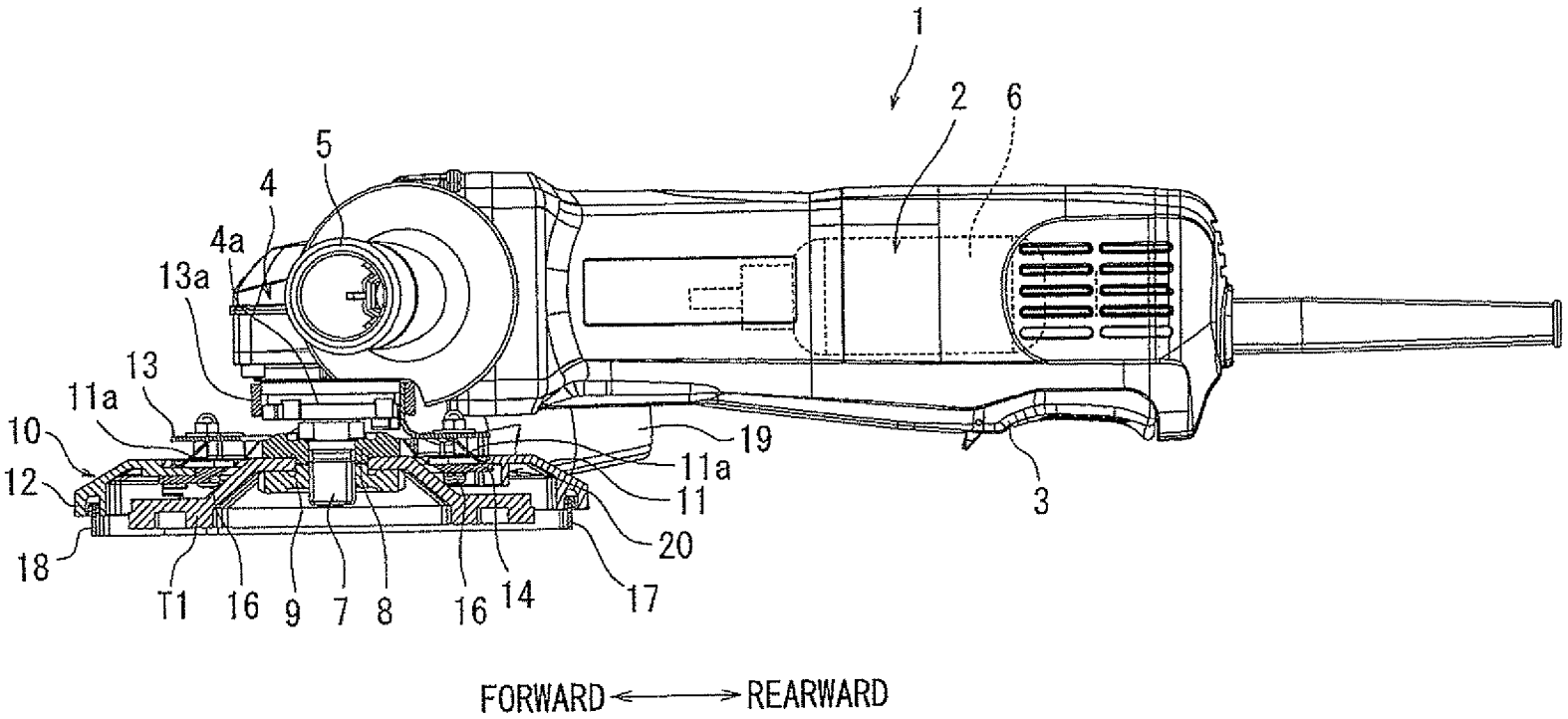
FIG. 1 is a side view of the entirety of an embodiment of a disk grinder provided with a dust collection cover. In this figure, the dust collection cover and a cup-shaped grinding tool are illustrated in a vertical section.

Next, embodiments of the present invention will be described with reference to FIGS. 1 to 10. FIG. 1 shows a hand-held type disk grinder 1. The disk grinder 1 includes a tool main body 2 having an electric motor 6 disposed therein. The tool main body 2 also has a grip section that is grasped by a user. The tool main body 2 may be provided with a switch lever 3. When the user pulls the switch lever 3 with a fingertip, the electric motor 6 may be started and then the disk grinder 1 can be used. A laterally projecting sub-grip 5 may be attached to a front side of the tool main body 2.

A gear head section 4 may be attached to a front section of the tool main body 2. A bevel gear train may be arranged inside the gear head section 4. The output of the electric motor 6 may be changed to an orthogonal direction via the bevel gear train. A spindle 7 may project from a lower portion of the gear head section 4. The rotation output of the electric motor 6 may be transmitted to the spindle 7 via the bevel gear train, A boss portion 4*a* may be arranged at the lower portion of the gear head section 4. The spindle 7 may be rotatably supported at the center of the boss portion 4*a*.

A cup-shaped grinding tool T1 may be attached to the spindle 7. The cup-shaped grinding tool T1 is preferably firmly fixed to the spindle 7 by a fixing flange 8 and a fastening nut 9 so as to be immovable in the axial direction and to not rotate about the axis. A cup-shaped diamond wheel may be used, for example, as the cup-shaped grinding tool T1.

A dust collection cover 10 preferably covers the entire cup-shaped grinding tool T1. The dust collection cover 10 may be attached to the boss portion 4*a* of the gear head section 4.

FIGS. 2 to 5 show the dust collection cover 10 of this embodiment in a separated state from the gear head section 4. The dust collection cover 10 of this embodiment includes a cover main body 11 and an auxiliary cover 12 separable from the cover main body 11. The cover main body 11 and the auxiliary cover 12 are made by integral molding processes of synthetic resin, respectively. When the auxiliary cover 12 is coupled to the resin cover main body 11, the entirety of the cup-shaped grinding tool T1 is preferably accommodated inside thereof. The cover main body 11 may be supported by the boss portion 4*a* of the gear head section 4 via an attachment base 13 and a receiving base 14. The attachment base 13 and the receiving base 14 can be made from steel plates.

The attachment base 13 may be positioned on an upper surface side of the cover main body 11. An attachment portion 13*a* having an annular shape may be arranged on the upper portion of the attachment base 13. A fixing screw 15 may be fastened in a state where the boss portion 4*a* of the gear head section 4 enters the inner circumference side of the attachment portion 13*a*, so that the attachment portion 13*a* and accordingly, the attachment base 13 are fixed to the boss portion 4*a*. When the fixing screw 15 is loosened, the position about the boss portion 4*a* can be adjusted.

Figure 6:
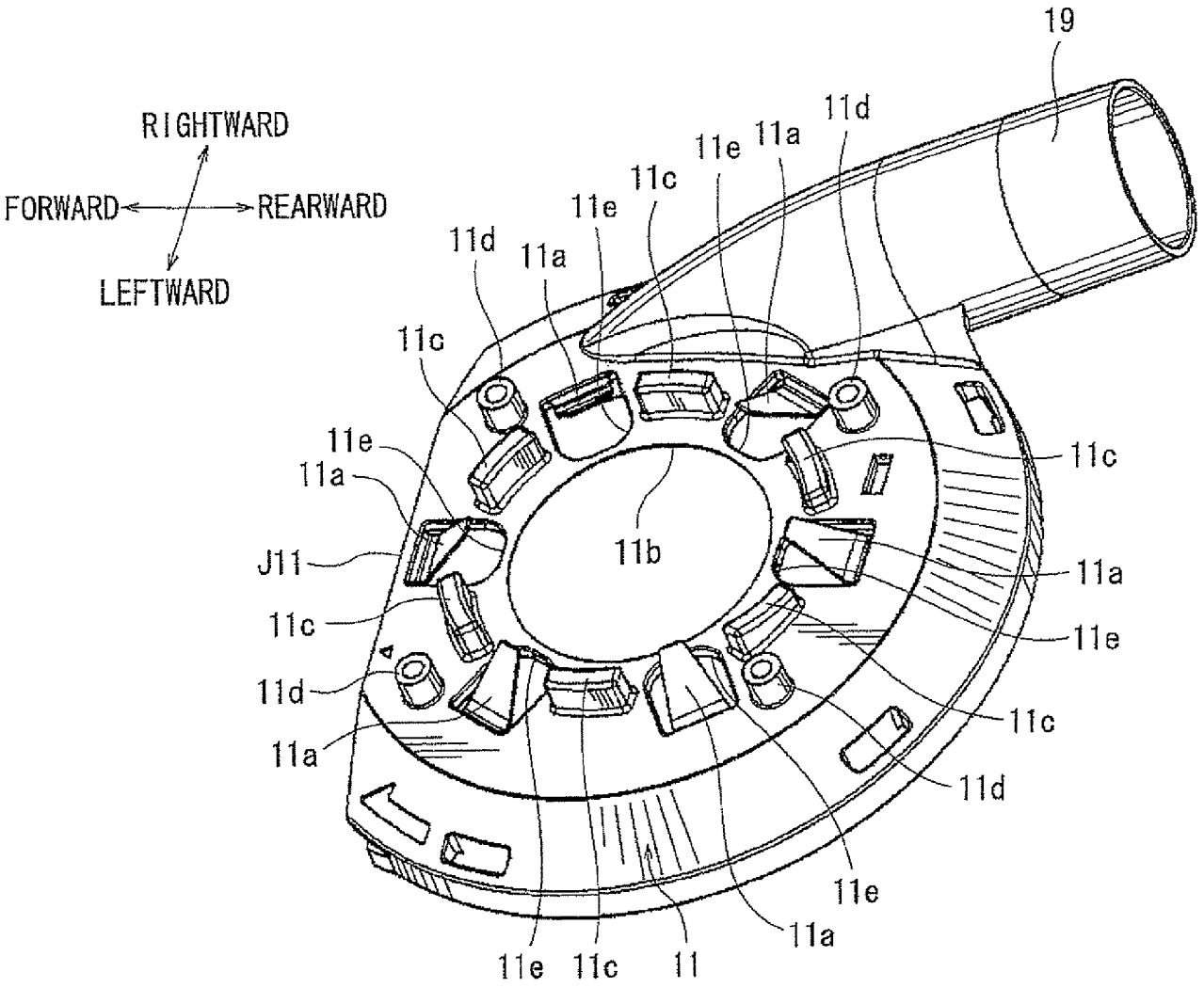
FIG. 6 is a perspective view of a cover main body.

The cover main body 11 may be supported on the attachment base 13 by four support screws 16. As shown in FIG. 6, the boss portions 11 *d* may be arranged at four positions on the upper surface of the cover main body 11. The support screw 16 may be inserted into each boss portion 11*d*. The receiving base 14 may be fixed to a lower surface (an inner surface) of the cover main body 11 by four support screws 16 whereby the receiving base and the lower surface of the cover may both overlap.

Each of the boss portions 11*d* of the cover main body 11 preferably extends through the attachment base 13 and is inserted therein so as to be vertically displaceable. Thus, the cover main body 11 is supported on the attachment base 13 in a state of being displaceable upward and downward.

A plurality of the leaf springs 11*a* is preferably arranged on the cover main body 11. In this embodiment, each leaf spring 11*a* is integrally formed when the cover main body 11 is molded (a resin spring 11*a*). Each leaf spring 11*a* extends obliquely upwardly and is pressed against the lower surface of the attachment base 13. The cover main body 11 is biased downward (the side of the receiving base 14) by the leaf springs 11*a*. Being biased by the leaf springs 11*a*, the cover main body 11 is supported by the attachment base 13 in an upwardly and downwardly displaceable floating state. The displacement amount of the cover main body 11 relative to the attachment base 13 in the downward direction is restricted by a washer 16*a* located around each support screw 16.

Increasing the durability of each leaf spring 11 *a* will be described. As shown in FIG. 6, each leaf spring 11*a* preferably has a tapered shape (a trapezoid) with a width decreasing toward the leading end. With this tapered shape, a part on the side of the leading end of each leaf spring 11*a* is more easily bent than the remaining part when each leaf spring 11*a* is pressed against the lower surface of the attachment base 13. Therefore, when the cover main body 11 is displaced in a direction whereby it approaches the attachment base 13 each leaf spring 11*a* is gradually bent and they generate a biasing force. As each leaf spring 11*a* is configured to be bent gradually from the leading end side, the amount of deformation thereof is distributed throughout the length of the leaf spring and is not concentrated at the base section. The durability of each leaf spring 11*a* thereby can be increased. If a bending stiffness of each leaf spring is high, however, it may be bent at the base end to generate a biasing force, and therefore, the base end may be plastically deformed or may be damaged by repeated displacement of the cover main body 11. As a result, the durability of the dust collection cover 1 may be decreased.

Figure 3:
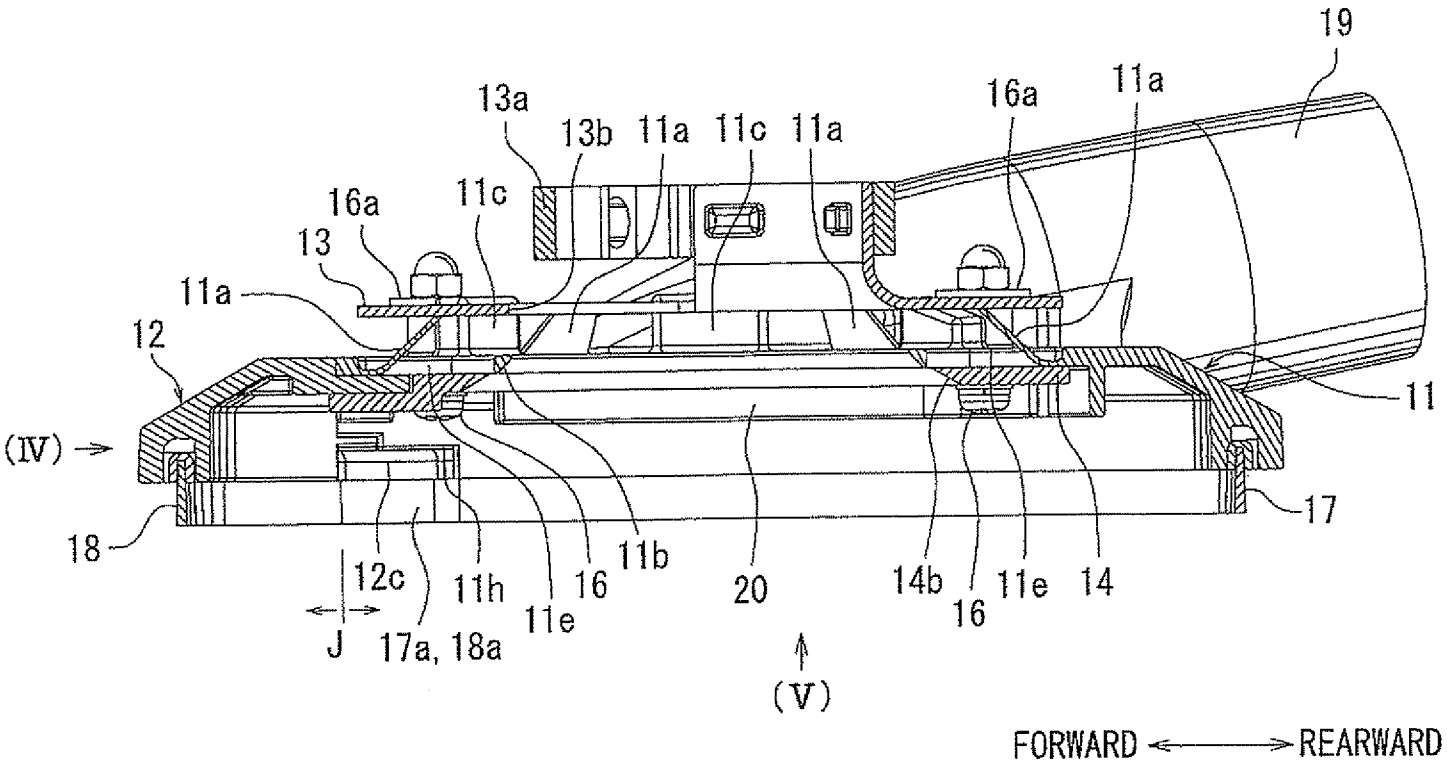
FIG. 3 is a cross-sectional view taken along an arrow in FIG. 2 and showing a vertical sectional view of the dust collection cover.
Figure 4:
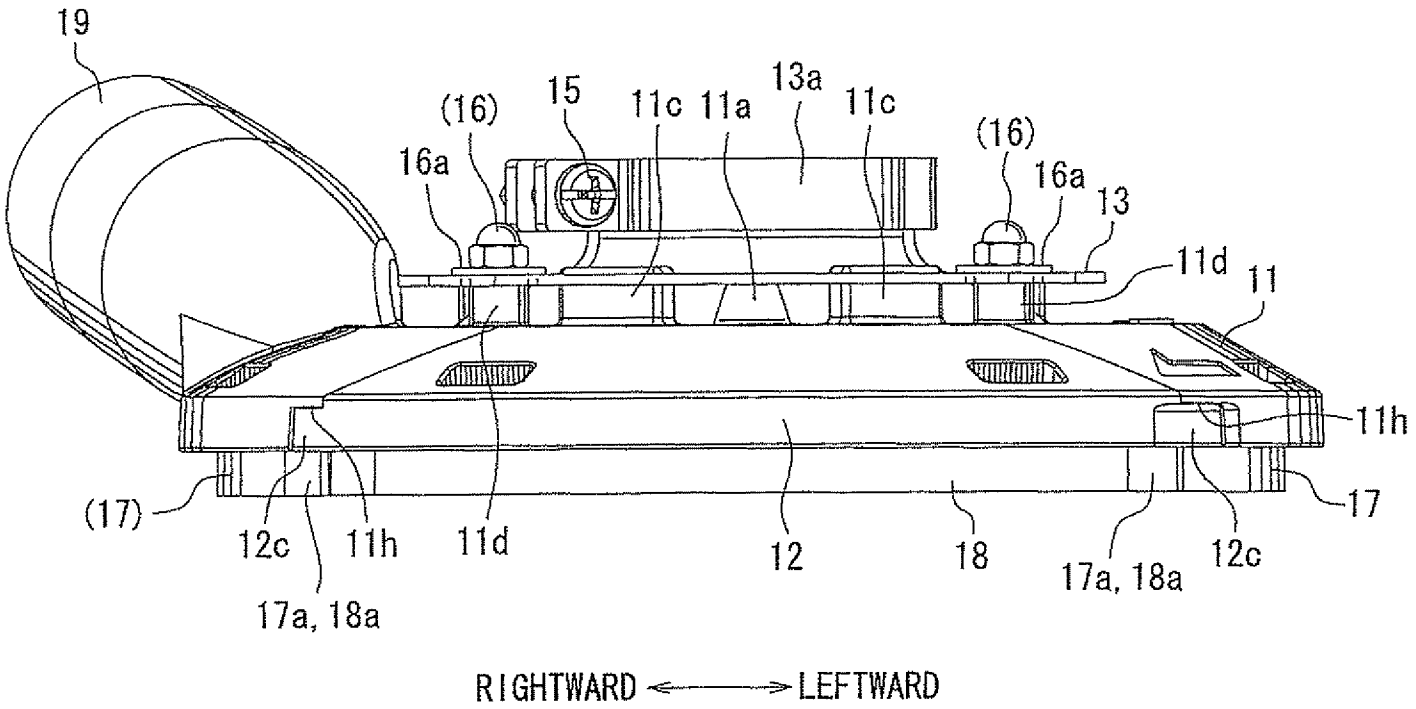
FIG. 4 is a front view of the dust collection cover as viewed from a direction of arrow (IV) in FIG. 3.

A relief hole 11*e* may be formed on the lower side of each leaf spring 11*a* and is necessary for pattern forming when the cover main body 11 and each leaf spring 11*a* are integrally molded. As shown in FIG. 3, the relief holes 11*e* at six positions are completely blocked mainly by the receiving base 14 so that dust collection efficiency of the dust collection cover 10 may not be impaired.

Relief holes 13*b* and 14*b* are arranged at the center of the attachment base 13 and the center of the receiving base 14, respectively, to correspond to the inserting hole 11*b* arranged at the center of the cover main body 11. The spindle 7 may enter into the inner circumference side of the inserting hole 11*b* of the cover main body 11 and both of the relief holes 13*b* and 14*b* so that interference thereof is avoided with respect to the fixing flange 8, the fastening nut 9 and the upper portion of the cup-shaped grinding tool T1 (an attachment portion T1*a*).

Six supporting wall portions 11*c* may be integrally arranged on the upper surface of the cover main body 11. These six supporting wall portions 11*c* may be arranged at six equally spaced positions on a circle about the inserting hole 11*b*. These six supporting wall portions 11*c* each enters the inserting hole 13*c* arranged at the attachment base 13, so that inclination (engagement) of the cover main body 11 with respect to the attachment base 13 is prevented, thereby enabling the cover main body 11 to smoothly move up and down relative to the attachment base 13.

Figure 5:
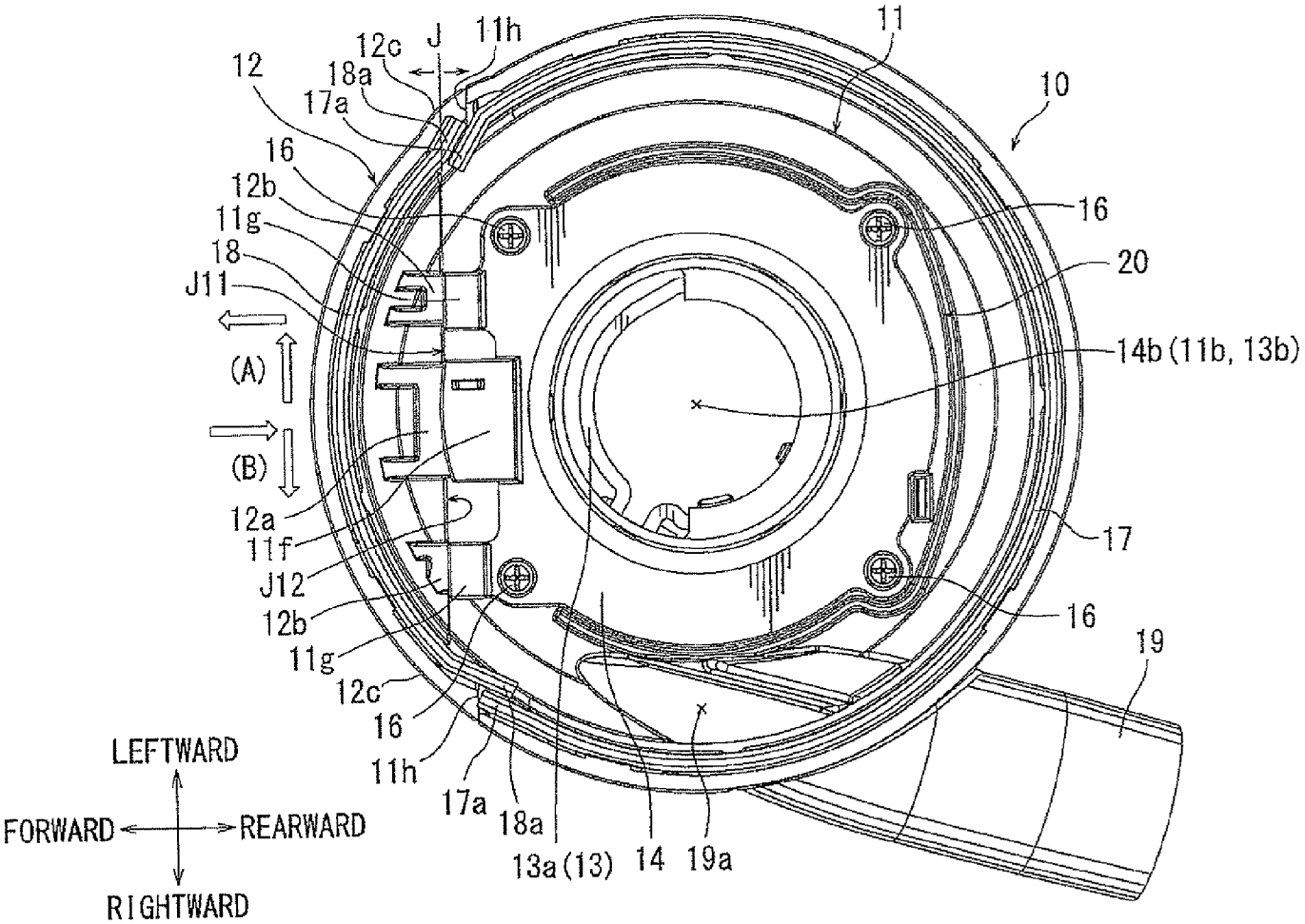
FIG. 5 is a bottom view of the dust collection cover as viewed from a direction of arrow (V) in FIG. 3.

A dust collection duct 19 may be arranged on the right side of the upper surface of the cover main body 11. The dust collection duct 19 is provided by being molded integrally when the cover main body 11 is molded. As shown in FIG. 5, the dust collection duct 19 is opened (at a dust collection port 19*a*) into the inside (a lower surface side) of the cover main body 11. A dust collection bag may be attached to the dust collection duct 19, otherwise a dust collecting device may be connected to the dust collection duct 19 via a hose, so that the collection of powder dust or the like generated inside the dust collection cover 10 can be effectively performed.

Figure 9:
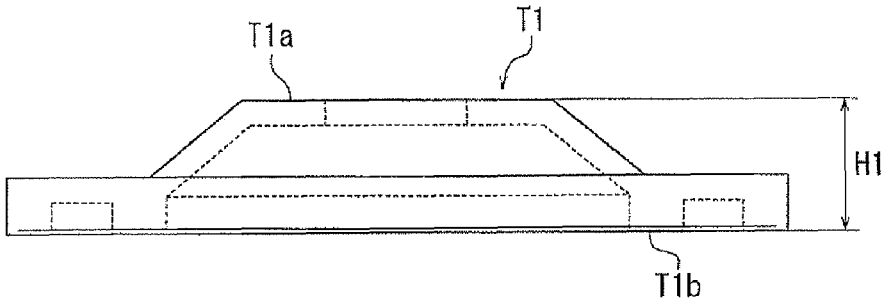
FIG. 9 is a side view of a cup-shaped grinding tool.
Figure 10:
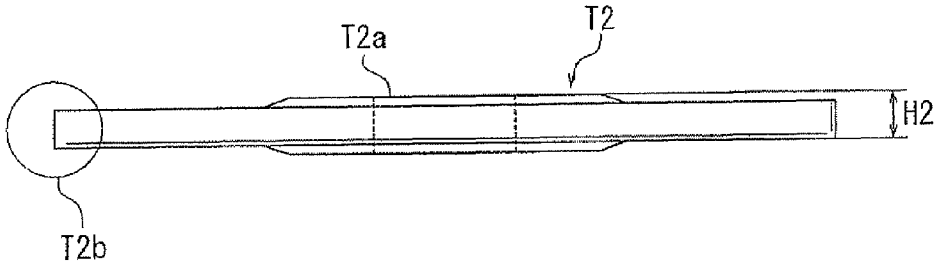
FIG. 10 is a side view of a disk-shaped grinding tool.

An attachment-restricting portion 20 may be arranged on the inner surface (the lower surface) of the cover main body 11, in order to enable attachment of the cup-shaped grinding tool T1 shown in FIG. 9 and to disable attachment of a disk-shaped grinding tool T2 shown in FIG. 10. As shown in FIG. 5, an attachment-restricting portion 20 may be arranged in a downwardly protruding state along the circumference of the receiving base 14.

As shown in FIG. 9, a height dimension H1 between (1) an attachment portion T1*a* (the upper surface that abuts the fixing flange 8) of the cup-shaped grinding tool T1 with respect to the spindle 7 and (2) a grinding portion T1*b* of the same with respect to a material to be ground is preferably set between 17 mm to 21 mm. In contrast, as shown in FIG. 10, a height dimension H2 between (1) an attachment portion T2*a* (the upper surface that abuts to the fixing flange 8) of the disk-shaped grinding tool T2 with respect to the spindle 7 and (2) a grinding portion T2*b* with respect to a material to be ground is set preferably, to about 6 mm to 7 mm.

A grinding operation is preferably performed using a cup-shaped grinding tool T1 to press the entire grinding section T1*b* (the entire circumference) against a material to be ground, such as concrete. A different grinding operation may be performed with the disk-shaped grinding tool T2 when only the front portion (a portion surrounded by a circle in FIG. 10) obliquely or perpendicularly against a material to be ground, such as steel material. In this way, a disk-shaped grinding tool T2 that is small in its height dimension H2 cannot be attached to the spindle 7, since the outer circumference of the disk-shaped grinding tool T2 may interfere with the attachment restricting portion 20 (i.e., the fastening nut 9 cannot be completely fastened). In contrast, as the height dimension H1 of the cup-shaped grinding tool T1 between the attachment portion T1*a* and the grinding portion T1*b* is large, its outer circumference may not interfere with the attachment restricting portion 20, and therefore, the cup-shaped grinding tool T1 can be attached to the spindle 7. In such an arrangement, the projecting path and the downward projecting dimension of the attachment-restricting portion 20 are appropriately set.

With the attachment restricting portion 20 arranged in this way, operations of the disk-shaped grinding tool T2 generally do not sparks or heated iron powder. Therefore, there is no need to use a high heat resistant for the cover main body 11 and the auxiliary cover 12, and hence, the cover main body 11 and the auxiliary cover 12 can be made from a lightweight material such as a resin. In a similar fashion, the cover main body 11 and the auxiliary cover 12 of the cup-shaped grinding tool T1 can be made from a lightweight resin.

Figure 2:
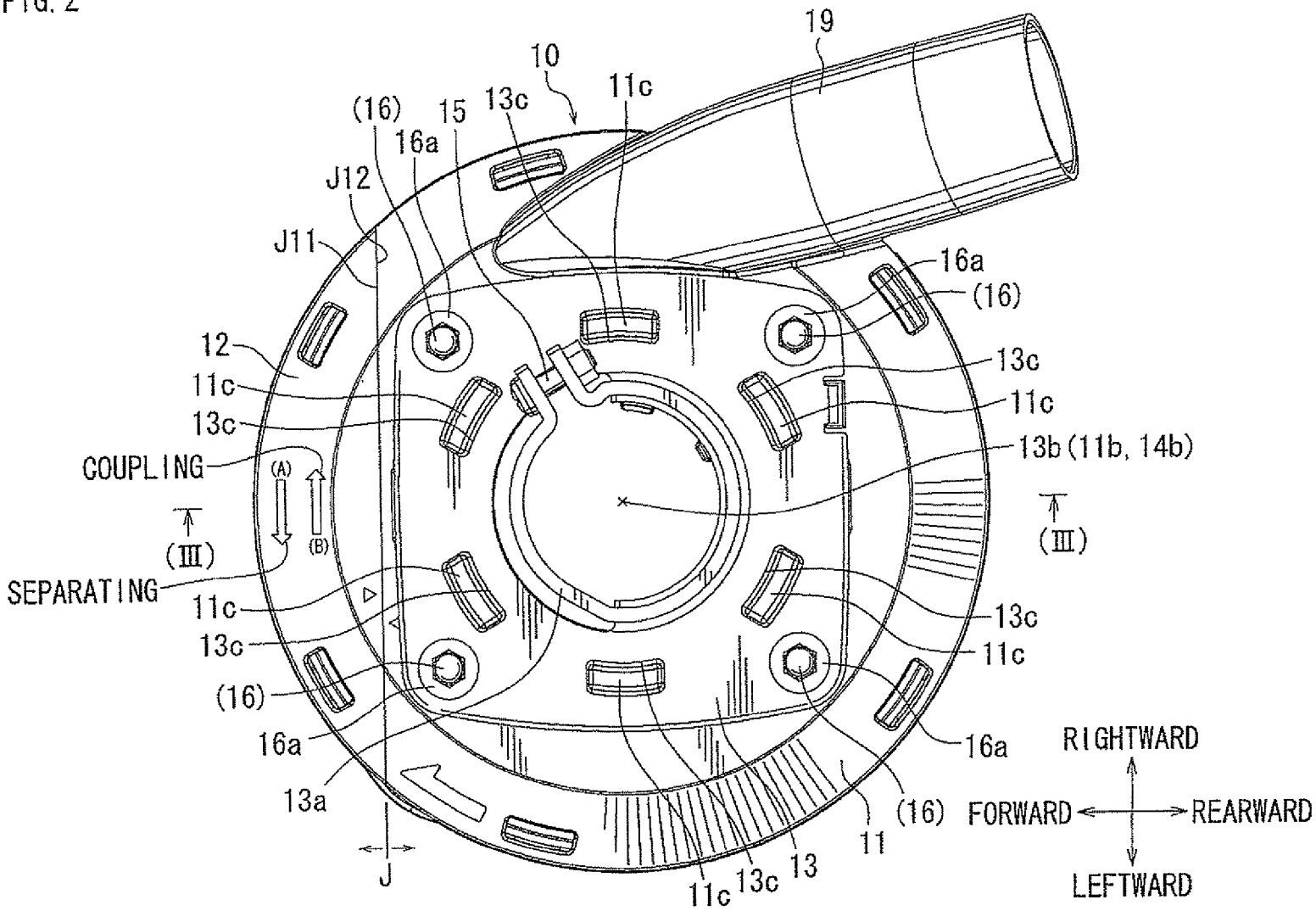
FIG. 2 is a plan view of an embodiment of a dust collection cover.

The auxiliary cover 12 may be detachably attached to the front portion of the cover main body 11. In FIG. 2, the auxiliary cover 12 is separated from the cover main body 11 at a position indicated by reference sign J. In the following description, a coupling surface of the cover main body 11 is labeled with reference sign J11 and a coupling surface of the auxiliary cover 12 is labeled with reference sign J12, in order to conveniently distinguish them from each other.

Figure 7:
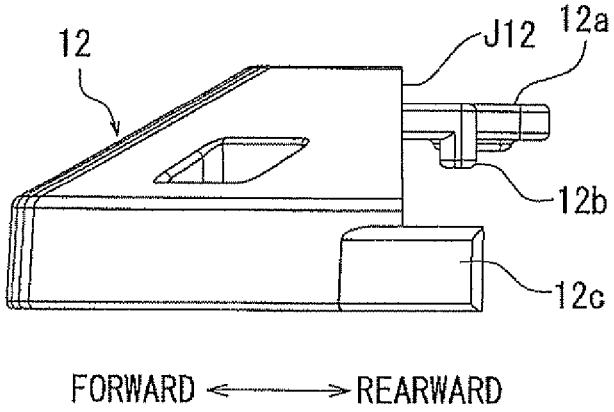
FIG. 7 is a left side view of an auxiliary cover.
Figure 8:
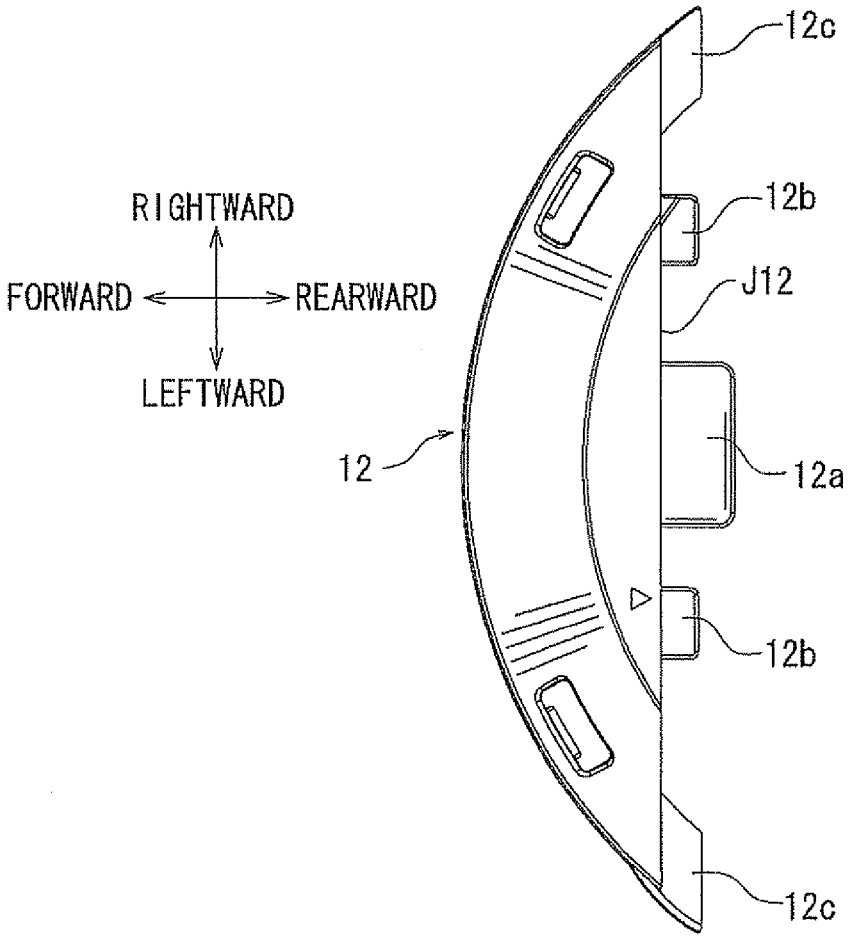
FIG. 8 is a plan view of the auxiliary cover.

The auxiliary cover 12 may be removed by manual operation of the user when a so-called edge cut is performed. The auxiliary cover 12, in a removed state, is shown in FIGS. 7 and 8. The auxiliary cover 12 can be separated after being slid to the right side with respect to the cover main body 11. Conversely, it can be coupled to the cover main body 11 by being slid to the left side with respect to the coupling surface J11 of the cover main body 11.

As shown in FIG. 8, on the coupling surface J12 of the auxiliary cover 12, there are integrally provided an upward and downward supporting plate 12*a* at the center with respect to the left and right directions. Separation restriction plates 12*b* are provided on its opposite sides. Overlap portions 12*c* are provided on opposite ends with respect to the left and right direction. As shown in FIG. 7, the central upward and downward supporting plate 12*a* has a flat plate shape and extends straight in the rearward direction. Each of the separation restricting plates 12*b* on both sides of it has an L-shape with its leading end bent downward and extends rearward. Left and right overlap portions 12*c* are preferably arranged where their circular arc portions on the front side extend toward the cover main body 11 (i.e., whereby they overlap).

Meanwhile, as shown in FIG. 5, on the coupling surface J11 of the cover main body 11, there is provided an upward and downward supporting concave portion 11*f* at the center in the left and right direction. On the opposite sides of the coupling surface J11, there are preferably separate restricting concave portions 11*g*. Also there may be overlapping concave portions 11*h* on the right and left sides of the coupling surface J11.

As indicated by a group (A) of outline arrows in FIG. 5, for separating the auxiliary cover 12 from the cover main body 11, the auxiliary cover 12 is slid to the left side with respect to the cover main body 11 and is thereafter displaced forwardly, so that it can be separated. Conversely, as indicated by a group (B) of outline arrows in FIG. 5, for coupling the auxiliary cover 12 to the cover main body 11, the coupling surface J12 of the auxiliary cover 12 is first brought to contact with the coupling surface J11 of the cover main body 11, and the auxiliary cover 12 is thereafter slid to the right side to cause the upward and downward supporting plate 12*a* to enter the upward and downward supporting concave portion 11*f*. This also causes the left and right separation restricting plates 12*b* to enter inside the overlap concave portions 11*h*, while simultaneously, the left and right overlap portions 12*c* may be fitted into the separation restricting concave portions 11*g*.

As the central upward and downward supporting plate 12*a* enters inside the upward and downward supporting concave portion 11*f*, the vertical position of the auxiliary cover 12 is determined relative to the cover main body 11. The separation regulation plates 12*b* positioned on both sides of the separation restricting concave portions 11*g* enter them from the right side so that the auxiliary cover 12 is positioned relative to the cover main body 11 with respect to the left and right direction so as to be inseparably coupled thereto. In addition, as the auxiliary cover 12 slides to the right side relative to the cover main body 11, the overlap portions 12*c* are fitted into the overlap concave portions 11*h* so that the front side circular arc portion of the auxiliary cover 12 and the outer circumference of the cover main body 11 are brought into a state of being smoothly continued with each other.

Next, dust-preventing brushes 17 and 18 are attached to the lower surfaces of the cover main body 11 and the auxiliary cover 12, respectively. Both of the dust-preventing brushes 17 and 18 may be attached along a circular arc path of the lower surface of the cover main body 11. The dust-preventing brush 17 is attached to the cover main body 11 such that opposite ends portions 17*a* projects into the overlap concave portion 11*h*. In addition, the dust-preventing brush 18 is attached to the auxiliary cover 12 such that opposite end portions 18*a* overlap with the overlap portion 12*c*. Thus, as shown in FIG. 5 when the auxiliary cover 12 is coupled to the cover main body 11, the opposite end portions 17*a* of the dust-preventing brush 17 on the side of the cover main body 11 overlap with the end portions 18*a* of the dust-preventing brush 18.

As described above, the auxiliary cover 12 is configured to be coupled to the cover main body 11 by sliding the auxiliary cover 12 from the left side to the right side and orthogonally from the front to the rear. Thus, in the coupled state, opposite end portions 18a of the dust-preventing brush 18 overlap with opposite end portions 17*a* of the dust-preventing brush 17. The auxiliary cover 12 may be configured such that the auxiliary cover 12 is coupled as it is slid to the right, whereby end portions 17*a* and 18*a* of both dust-preventing brushes 17 and 18 can be securely overlapped with each other.

Because the opposite end portions 18*a* of the dust-preventing brush 18 on the side of the auxiliary cover 12 are securely overlapped with the opposite end portions 17*a* of the dust-preventing brush 17 on the side of the cover main body 11, there is no significant gap therebetween. Therefore powder dust or the like generated in the dust collection cover 10 may be prevented from leaking to the outside, resulting in an improved dust collection cover 10.

In the dust collection cover 10 of the above-described embodiment, the cover main body 11 and the auxiliary cover 12 may be made from synthetic resin to provide a lightweight dust collection cover 10. The portability and ease of use of such a dust collection cover can be improved.

The cover main body 11 and the auxiliary cover 12 made from the synthetic resin can also cope sufficiently with sparks and heated iron powder due to the attachment restricting portion 20 arranged on the cover main body 11. Thus, due to interference of the attachment restricting portion 20 arranged at the cover main body 11, attachment of the disk-shaped grinding tool T2 is restricted and attachment of only the cup-shaped grinding tool T1 is permitted. Therefore, a disk grinder 1 with the exemplified dust collection cover 10 attached generally is not used for operations such as deburring or cutting of steel material which result in the scattering of sparks and/or hot iron powder. Instead, work involving the grinding of concrete or stone material may generally be performed as such work generally does not result in the production of sparks or hot iron powder. Such work may be performed by pressing the entire surface of the grinding section T1*b* against the material to be ground.

In this way, using a dust collection cover 10 is generally not used for a work that may tend to generate heated iron powder or sparks because a grinding tool T2 may not be attached. Therefore problems with heat resistance or durability may not occur even when the cover main body 11 and the auxiliary cover 12 are made from lightweight synthetic resin.

When the auxiliary cover 12 is detached from the cover main body 11, it is possible to perform an edge cut operation by the cup-shaped grinding tool T1.

Furthermore, because the cover main body 11 and the auxiliary cover 12 are supported by the gear head section 4 in a floating manner, the cover main body 11 and/or the auxiliary cover 12 can absorb impacts which would otherwise damage other parts. In this way, durability can be improved.

In addition, because the leaf spring portions 11*a* (resilient members), which support the cover main body 11 and the auxiliary cover 12 in a floating manner with respect to the gear head section 4, are integrally molded with the cover main body 11, the number of parts used in assembling the dust collection cover 10 can be minimized to result in improved ease of assembling.

Furthermore, the leaf spring portions 11*a* are formed to be tapered toward the tip ends such that the width dimension thereof is decreased toward the tip ends. Therefore, when an external bending force is applied to the leaf spring portions 11*a* while supporting the cover main body 11 in a floating manner, bending (curving) deformation occurs starting at the tip ends. Accordingly, stress concentration on the base portions where the leaf spring ports 11*a* to 11*a* are cut and raised can be decreased or avoided, and therefore, the durability of the leaf spring portions 11 a can be improved.

In addition, according to the exemplified dust collection cover 10, joint portions of the circumferential edges of the cover main body 11 and the auxiliary cover 12 overlap with each other to minimize or preferably remove any gap, so that the entire circumference of the cup-shaped grinding tool T1 can be completely covered. In this way, it is possible to maintain dust collection efficiency, despite the detachable construction to enable detachment of the auxiliary cover 12 and the cover main body 11.

Furthermore, the auxiliary cover 12 may be configured such that it may be slid left and right relative to the cover main body 11 for separation and coupling. The edge portions of the dust-preventing brushes 17 and 18 can be reliably overlapped with each other, to ensure a high level of protection from dust.

Various changes can be made to the above-described embodiments. For example, the leaf spring portions 11*a* are preferably tapered toward their end tips. It may possible, however, to configure them such that their plate thickness is gradually decreased (thinned) toward the side of the tip ends to cause bending (curving) deformation (curved) starting from the side of the tip ends.

In addition, although the leaf spring portions 11*a* integrally formed with the cover main body 11 were exemplified as the resilient member that supports the cover main body 11 in a floating state, it may be possible to use leaf springs prepared as separate members, and it may be also possible to use resilient members other than the leaf springs such as compression coil springs or urethane rubbers.

Furthermore, although the cover main body 11 and the auxiliary cover 12 are preferably supported in a floating state with respect to the gear head section 4, this floating support structure may be omitted. The leaf spring portions 11*a* may also be omitted such that the cover main body 11 is generally fixed to the attachment base 13. In this configuration, the relief holes 11 e for pattern forming can be omitted. The receiving base 14 may also be omitted.

In addition, the auxiliary cover 12 is preferably separated and coupled as it is slid in the left and right directions (directions indicated by outline arrows (A) and (B) in FIG. 2) that are orthogonal to the separating and coupling directions (the forward and rearward directions) with respect to the cover main body 11. It may be possible, however, to configure the auxiliary cover 12 such that it can be separated from the cover main body 11. Conversely, it could be coupled to the cover main body 11 such that it could be displaced in the forward and rearward directions without required sliding in the left and right directions.

Furthermore, although a single elongated linear projection continuously extending along the circumference of the receiving base 14 was exemplified as the attachment-restricting portion 20, it may be constructed from a plurality of linear projections or protrusions in a distributed manner.

The diamond wheel was exemplified as the cup-shaped grinding tool T1, however, other than this, it may be possible to use an abrasive paper attached to its lower surface with an intervening rubber pad.

The invention claimed is:

1. A dust collection cover of a disk grinder comprising a spindle rotated by an electric motor disposed within a tool main body section, and a grinding tool attached to the spindle, the spindle being attached to a case that rotatably supports the spindle, the dust collection cover comprising:

an auxiliary cover arranged detachably from a cover main body enabling a portion of the grinding tool to protrude from the cover main body, wherein the cover main body and the auxiliary cover are molded from synthetic resin, wherein a cup-shaped grinding tool having a large height dimension with respect to a height dimension between an attachment portion to the spindle and a grinding portion that contacts a material to be ground, is attachable to the spindle, a tool having a small height dimension is not attachable to the spindle due to an attachment restricting portion integrated with the cover main body and protrudes downward from a lower surface of the cover main body, wherein the cover main body includes a radially extending wall portion and a circumferential wall portion, wherein the radially extending wall portion has a substantially annular shape about an axis of the spindle and includes a mount portion configured to be mounted to the case, wherein the circumferential wall portion extends downward from the outer circumference of the radially extending wall portion and configured to cover the cup-shaped grinding tool from a radially outer side, and wherein the attachment restricting portion extends downward from a lower surface of the radially extending wall portion at a position spaced from the circumferential wall portion in a direction radially inward therefrom.

an attachment base attachable to the case, and a receiving base configured to support the cover main body such that the cover main body is held between the attachment base and the receiving base;

wherein the attachment restricting portion extends along a circumference of the receiving base, and wherein the attachment restricting portion has a shape substantially conforming to a shape of an outer circumferential edge of the receiving base, so that the attachment restricting portion extends along the outer circumferential edge of the receiving base when the cover main body is held between the attachment base and the receiving base.

2. The dust collection cover according to claim 1, wherein a resilient member is interposed between the attachment base and the cover main body so that the cover main body is resiliently supported on the case.

3. The dust collection cover according to claim 2, wherein the resilient member is a leaf spring portion integrally molded with the cover main body in a cut-and-raised state.

4. The dust collection cover according to claim 3, wherein the leaf spring is configured to be tapered with respect to a width dimension and/or a plate thickness dimension toward the cut and raised tip end.

5. The dust collection cover according to claim 1, wherein the auxiliary cover can be separated and coupled to the cover main body by moving in a sliding direction and a separating direction that is orthogonal to the sliding direction, and a coupling portion for connecting the auxiliary cover to the cover main body such that circumferential end portions of the cover main body overlap with each other.

6. A dust collection cover of a disk grinder comprising a spindle rotated by an electric motor disposed within a tool main body section, and a grinding tool attached to the spindle, the spindle being attached to a case that rotatably supports the spindle, the dust collection cover comprising:

an auxiliary cover arranged detachably from a cover main body enabling a portion of the grinding tool to protrude from the cover main body, wherein the cover main body and the auxiliary cover are molded from synthetic resin, wherein a cup-shaped grinding tool having a large height dimension with respect to a height dimension between an attachment portion to the spindle and a grinding portion that contacts a material to be ground, is attachable to the spindle, a tool having a small height dimension is not attachable to the spindle due to an attachment restricting portion arranged near the cover main body;

an attachment base supporting the cover main body on the case, a resilient member interposed between the attachment base and the cover main body so that the cover main body is resiliently supported on the case;

wherein the resilient member is a leaf spring portion integrally molded with the cover main body in a cut-and-raised state; and a receiving base configured to support the cover main body such that the cover main body is held between the attachment base and the receiving base while the cover main body is pressed against the receiving base by a resilient force of the leaf spring portion, wherein a plurality of support wall portions are formed integrally with the cover main body and are alTanged along a circumferential direction of the cover main body so as to be spaced from each other in the circumferential direction, wherein the plurality of support wall portions protrude from the cover main body toward the attachment base, wherein a plurality of inserting holes are formed in the attachment base at positions corresponding to the plurality of support wall portions, and wherein each of the support wall portions is inserted into the corresponding insertion hole so that the cover main body is guided by the attachment base with respect to a movement in an axial direction.

7. The dust collection cover according to claim 6, wherein the attachment base and the receiving base are formed of steel plates.

8. The dust collection cover according to claim 6, wherein:

the receiving base is a separate member from the cover main body;

the receiving base has a relief hole configured to allow passage of the spindle; and the receiving base extends in a circumferential direction around the spindle.

9. A dust collection cover of a disk grinder comprising a spindle rotated by an electric motor disposed within a tool main body section, and a grinding tool attached to the spindle, the spindle being attached to a case that rotatably supports the spindle, the dust collection cover comprising:

an auxiliary cover detachably connected to a cover main body to encircle the grinding tool when connected and enable a portion of the grinding tool to protrude from the cover main body when disconnected, wherein the cover main body and the auxiliary cover are molded from synthetic resin, a coupling portion on the auxiliary cover and a coupling portion on the cover main body for connecting the auxiliary cover to the cover main body in a final secured position where adjacent surfaces of the auxiliary cover are in contact with adjacent surfaces of the cover main body and circumferential end portions of the auxiliary cover overlap with circumferential end portions of the cover main body;

wherein the auxiliary cover can be disconnected from the cover main body by moving the auxiliary cover in a sliding direction while the adjacent surfaces of the auxiliary cover remain in contact with the adjacent surfaces of the cover main body to eliminate the overlap of the circumferential end portions of the auxiliary cover from the circumferential end portions of the cover main body followed by moving the auxiliary cover in a separating direction that is orthogonal to the sliding direction to create a separation distance between the adjacent surfaces of the auxiliary cover and the adjacent surfaces of the cover main body;

wherein the auxiliary cover can be connected to the cover main body by moving the auxiliary cover in a direction opposite to the separating direction to eliminate the separation distance between the adjacent surfaces of the auxiliary cover and the adjacent surfaces of the cover main body followed by moving the auxiliary cover in a direction opposite to the sliding direction while the adjacent surfaces of the auxiliary cover remain in contact with the adjacent surfaces of the cover main body to the final secured position where the circumferential end portions of the auxiliary cover overlap with the circumferential end portions of the cover main body;

wherein the sliding direction and the separating direction are substantially within a same plane that is parallel to a bottom surface of the grinding tool, wherein when the auxiliary cover is connected to the cover main body, the auxiliary cover must move in both the sliding direction and the separating direction relative to the cover main body in order to disconnect the auxiliary cover from the cover main body.

10. The dust collection cover according to claim 9, wherein the sliding direction extends along a direction substantially tangential to a circle about the axis of the spindle.

* * * * *